United States Patent [19]

Kamishima et al.

[11] Patent Number: 4,910,854

[45] Date of Patent: Mar. 27, 1990

[54] PROCESS OF AND APPARATUS FOR GAPPING A SLIDE FASTENER

[75] Inventors: Kazuo Kamishima, Toyana; Hideo Shimai, Namerikawa, both of Japan

[73] Assignee: Yoshida Kogyo K.K., Tokyo, Japan

[21] Appl. No.: 365,700

[22] Filed: Jun. 14, 1989

[30] Foreign Application Priority Data

Jun. 17, 1988 [JP] Japan ..... 63-150897

[51] Int. Cl.[4] ..... B26D 1/06

[52] U.S. Cl. ..... 29/410; 29/770; 83/921

[58] Field of Search ..... 29/408, 410, 766, 767, 29/770, 33.2; 83/921; 225/94

[56] References Cited

U.S. PATENT DOCUMENTS

| | | | |
|---|---|---|---|
| 3,812,573 | 5/1974 | Fukuroi | 29/410 |
| 3,958,319 | 5/1976 | Takamatsu | 29/410 |
| 4,019,240 | 4/1977 | MacFee | 29/408 |
| 4,091,532 | 5/1978 | MacFee | 29/770 |
| 4,131,223 | 12/1978 | Aureli | 225/94 |
| 4,206,544 | 6/1980 | Shimai | 29/770 |
| 4,206,669 | 6/1980 | Fisher et al. | 29/408 |
| 4,241,489 | 12/1980 | Manning | 29/408 |
| 4,274,191 | 6/1981 | Ervin et al. | 29/408 |
| 4,324,033 | 4/1982 | MacFee | 29/408 |
| 4,325,185 | 4/1982 | Kanzaka | 29/770 |
| 4,625,382 | 12/1986 | Shirakawa et al. | 29/408 |

*Primary Examiner*—P. W. Echols

*Attorney, Agent, or Firm*—Hill, Van Santen, Steadman & Simpson

[57] ABSTRACT

A process and apparatus is disclosed for gapping a slide fastener chain to provide an element-free zone at predetermined intervals along a respective fastener stringer. The process essentially comprises cutting a connecting string interconnecting a series of discrete coupling elements secured by sewn seams to a support tape and simultaneously cutting a predetermined member of coupling elements, or alternatively cutting the string and arresting part of the coupling elements, followed by cutting the latter, so as to provide element-free tape zones with the sewn substantially in the form of an arch.

2 Claims, 6 Drawing Sheets

PROCESS OF AND APPARATUS FOR GAPPING A SLIDE FASTENER

BACKGROUND OF THE INVENTION

1. Field of the Invention

This invention relates to a process of gapping a slide fastener chain, more particularly of providing element-free zones at predetermined intervals on and along a longitudinal edge of a continuous slide fastener stringer carrying therealong a series of coupling elements formed by injection or extrusion molding and interconnected by a connecting string. The invention further relates to an apparatus for carrying this process into practice.

2. Prior Art

A typical form of slide fastener stringers to which the invention is applied comprises, as shown in FIGS. 15 and 16 of the accompanying drawings, a support tape carrying along one of its longitudinal edges a multiplicity of discrete coupling elements interconnected by a connecting string and secured in place by sewn seams, each of the coupling elements having a coupling head portion and upper and lower leg portions mounted astride the tape edge. During the course of finishing such elongate fastener stringer which is usually dyed, it is the common practice to remove certain numbers of the coupling elements to provide "space" or element-free zones at predetermined intervals on the support tape which are utilized subsequently for threading sliders through the tape and for attachment of upper and lower end stop members, the stringer being thereafter cut across the element-free zones into individual fastener lengths.

There have heretofore been proposed numerous means of gapping a slide fastener chain, a typical prior art example of which is introduced in U.S. Pat. No. 4,131,223 wherein the gapping operation is automated with use of coacting cutters adapted to sever the coupling elements and another set of cutters to cut off the connecting string which interconnects adjacent individual elements on a slide fastener chain having two stringers in coupled condition. The coacting cutters are disposed in vertically offset positions such that the support tape is forced to assume substantially "S"-letter like flexed posture as the cutters sever the elements and further advance toward each other until severed element debris are pulled apart. This arrangement has a drawback in that the cutters would impair the tape and often exert undue stresses upon and sometimes cut the sewing threads which are securing the elements to the tape. Should this happen, the sewing threads extending over a length of operative coupling elements would become loosened, resulting in malaligned element arrays and in unsightly frayed sewn seams.

SUMMARY OF THE INVENTION

With the foregoing drawbacks of the prior art in view, it is the primary object of the present invention to provide a process of gapping a slide fastener chain which will automatically provide element-free zones on one of the two fastener stringers (constituting a chain) without impairing the support tape or exerting undue tension tending to cut the sewn seams which secure the fastener elements to be removed.

According to the process of the invention, the sewn seams from which the fastener elements are released will remain intact substantially in the form of an arch so that the remaining operative elements over effective product lengths are held unaffected as to their alignment.

A process according to one embodiment of the invention essentially comprises the steps of a) cutting simultaneously a connecting string interconnecting a series of discrete coupling elements on a support tape and a predetermined number of coupling elements simultaneously; b) arresting the leg portions of the coupling elements that have been cut; c) pulling apart the head portions of the coupling elements that have been cut; and d) removing the remaining leg portions of the coupling elements from the tape.

According to another embodiment of the invention, a process comprises the steps of a) cutting a connecting string interconnecting a series of discrete coupling elements on a support tape and simultaneously arresting the leg portions of the coupling elements which are to be cut; b) cutting the coupling elements; c) pulling apart the head portions of the coupling elements that have been cut; and d) removing the leg portions of the coupling elements from the tape.

An apparatus for carrying the above processes of the invention into practice includes a first pair of upper and lower coacting cutters each having a part for cutting the connecting string and a part for holding leg portions of the coupling elements, respectively, and a second pair of upper and lower coacting cutters each having a respective part for cutting the coupling elements between the head and leg portions thereof, the upper cutters and lower cutters of the respective pairs being combined in relatively movable superposed relation.

The above and other objects and features of the invention will become more apparent from the following detailed description taken in conjunction with the accompanying drawings. Like reference numerals refer to like or corresponding parts throughout the several views of the drawings.

DETAILED DESCRIPTION

Figure 15:
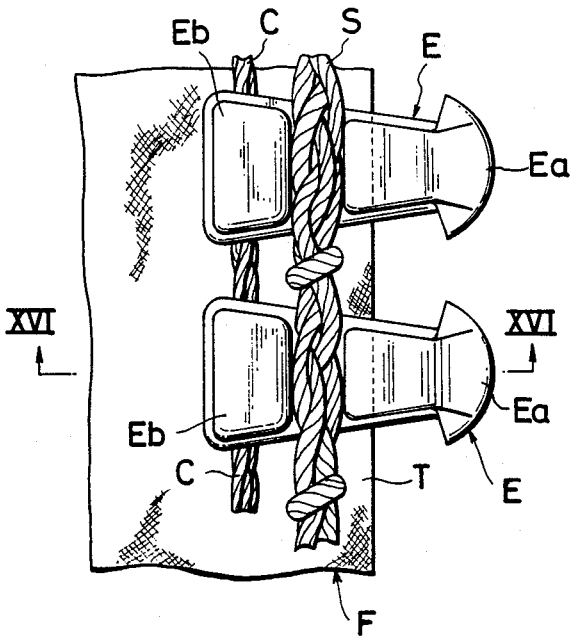
FIG. 15 is a fragmentary plan view of a slide fastener stringer.
Figure 16:
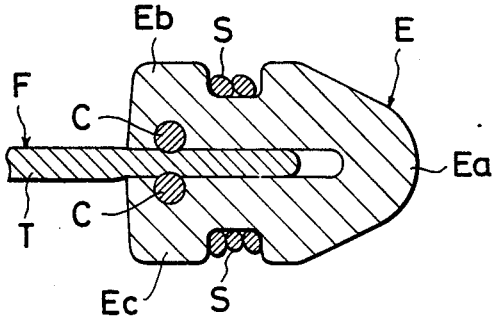
FIG. 16 is a cross-sectional view taken along the line XVI—XVI of FIG. 15

Referring now to the drawings, firstly to FIGS. 15 and 16, there is shown a slide fastener stringer F of the kind which is processed according to the invention and which comprises a support tape T, and a series of discrete coupling elements E secured by sewn seams S to an inner longitudinal edge of the tape T, the coupling elements E having a head portion Ea and an upper leg portion Eb and a lower leg portion Ec respectively interconnected by a pair of connecting strings C and mounted astride the tape edge as better shown in FIG. 16.

Reference to FIG. 1-7 inclusive shows a first pair of vertically disposed coacting cutters 11 and 12 and a second pair of vertically disposed coacting cutters 13 and 14, this cutter arrangement constituting an important aspect of a gapping apparatus 10 embodying the invention.

Figure 1:
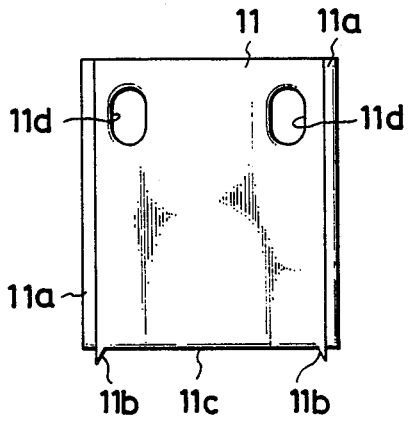
FIG. 1 is a front plan view of a first upper cutter.

The upper cutter 11 in the first pair as shown in FIG. 1 is in the form of a rectangular plate having an outwardly directed flange 11*a* on each of its longitudinal edges, a pair of blades 11*b* downwardly projecting integrally from a lower transverse edge 11*c* of the plate adjacent to the respective flanges 11*a*, and a pair of oblong apertures 11*d* in the upper portion of the plate adjacent to the respective flanges 11*a*. The lower transverse edge 11*c* of the cutter 11 serves as an abutment to press and hold the fastener coupling elements.

Figure 4:
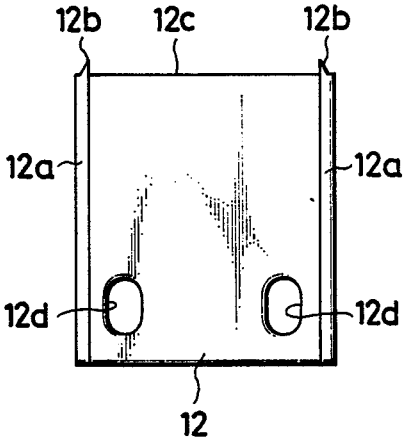
FIG. 4 is a front plan view of a first lower cutter.

The lower cutter 12 in the first pair shown in FIG. 4 is substantially identical with the upper cutter 11 when oriented up end down, except that the cutter blades 12*b* is formed integrally with the respective flanges 12*a*.

The pair of blades 11*b* are spaced apart by a distance corresponding to a predetermined length of an element-free zone or a gapped portion to be formed on the tape T. The projecting length of each blade 11*b* corresponds to or is slightly greater than the thickness of either of the upper and lower leg portions Eb and Ec.

Figure 2:
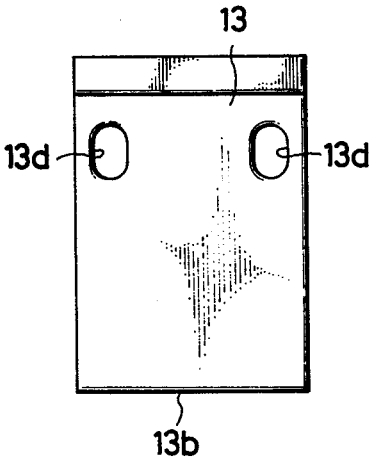
FIG. 2 is a back plan view of a second upper cutter.
Figure 5:
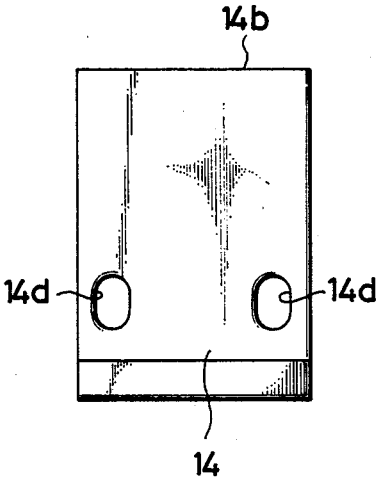
FIG. 5 is a back plan view of a second lower cutter.

The upper cutter 13 and lower cutter 14 in the second pair are identical as shown in FIG. 2 and 5 respectively in that they are in the form of a rectangular plate with a pair of oblong apertures 13*d* in the upper cutter 13 similar to and registering with corresponding apertures 11*d* in the upper cutter 11 in the first pair and similarly with apertures 14*d* in the lower cutter 14 corresponding to those in the lower cutter 12 in the first pair. The blade 13*b* of the upper cutter 13 in the second pair is formed at and coextensive with the lower transverse edge of the plate, while the blade 14*b* in the lower cutter 14 is formed at and coextensive with the upper transverse edge of the plate.

Figure 3:
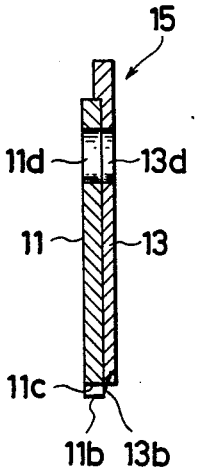
FIG. 3 is a longitudinal cross-sectional view of the first and second cutters shown coupled together.
Figure 6:
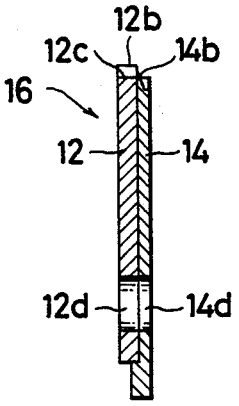
FIG. 6 is a longitudinal cross-sectional view of the first and second lower cutters shown coupled together.
Figure 7:
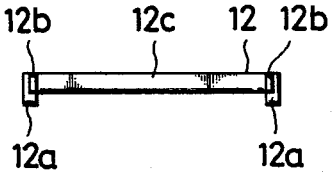
FIG. 7 is an end view of the first lower cutter.

In the operation of the above cutter device, the first upper and lower cutters 11 and 12 are used in combination with the second upper and lower cutters 13 and 14 respectively. The second upper cutter 13 is inserted through the flanges 11*a* of the first upper cutter 11 and engaged face to face with the latter, with their respective oblong apertures 13*d* registered with corresponding apertures 11*d* in the first upper cutter 11 to provide an upper cutter combination 15 as shown in FIG. 3. The first lower cutter 12 and the second lower cutter 14 are assembled in a similar manner to provide a lower cutter combination 16 as shown in FIG. 6.

According to the first embodiment of the inventive process wherein both the connecting strings C and the coupling elements E are cut off simultaneously, the first cutters 11 and 12 combined with the second cutters 13 and 14 respectively are arranged with the respective blade tips aligned and flush with each other in the respective combinations.

Figure 8:
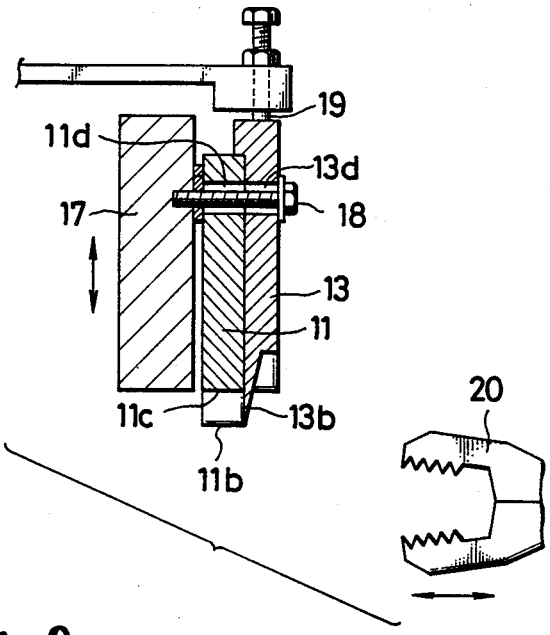
FIG. 8 is a longitudinal cross-sectional view of the first and second upper cutters secured to a moving block.

FIG. 8 shows how the upper cutter combination 15 is supported for operative movement. (This equally applies to the lower cutter combination.) The upper cutter combination 15 is secured to a moving block 17 by a bolt 18 extending through the aligned apertures 11*d* and 13*d*, the block 17 being vertically reciprocated by a cylinder not shown. Designated at 19 is a limiter adapted to limit the upward movement of the cutter combination 15. Designated at 20 also in FIG. 8 is a gripper horizontally movable toward and away from the cutter combination 15 (16) and adapted to releasably hold the head portions Ea of the coupling elements E.

Figure 9:
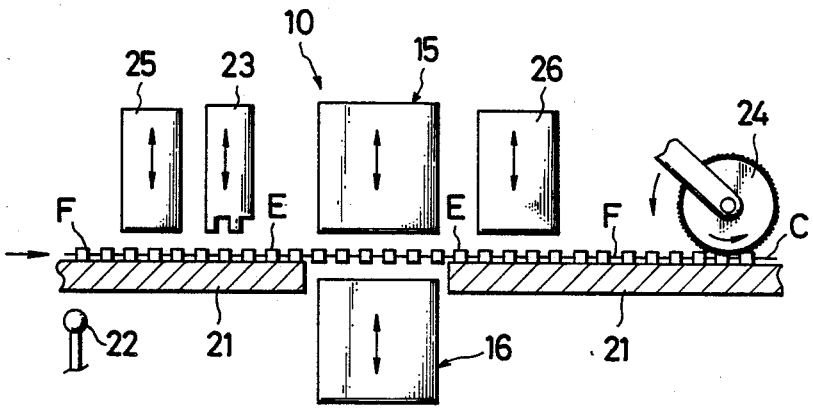
FIG. 9 is a schematic elevational view of a gapping apparatus embodying the invention.
Figure 10:
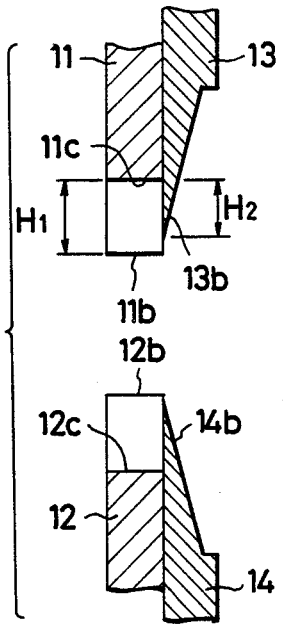
FIGS. 10, 11, 12 and 13 inclusive are cross-sectional views utilized to explain the process steps employed according to the invention.
Figure 11:
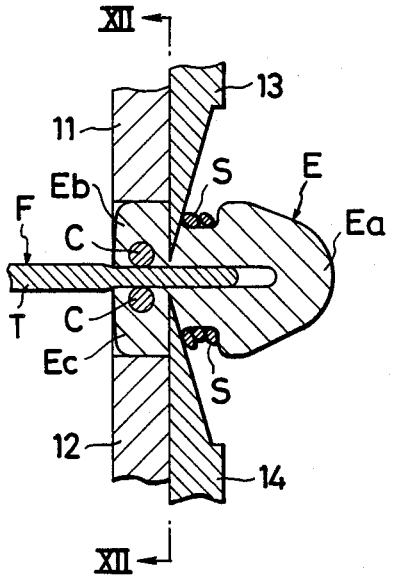
Figure 12:
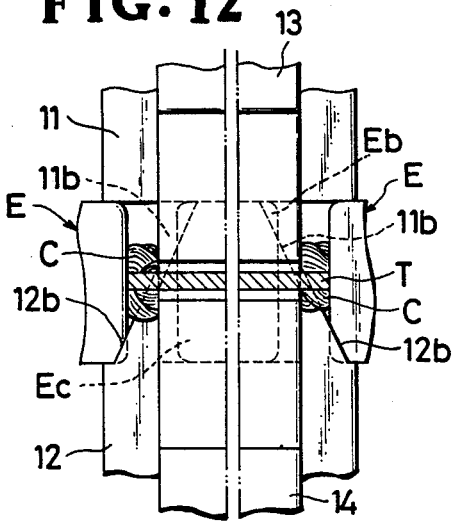
Figure 13:
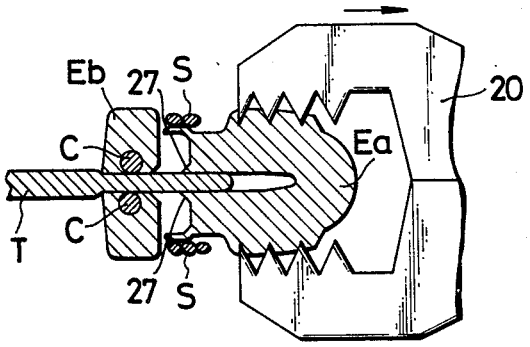

FIG. 9 schematically illustrates the arrangement of the apparatus which implements the inventive process, wherein a continuous length of fastener stringer F is fed in the direction of the arrow along a horizontal path of travel defined by a guide block 21 intercepted by a space through which the upper and lower cutter combinations 15 and 16 are brought into engagement the stringer F. As the stringer F advances past a sensor 22 located upstream of the cutter position, it is discontinued upon passage of a predetermined number of coupling elements E through the sensor 22. A toothed presser member 23 downstream of the sensor 22 blocks the elements E and a tensioning member 24 downstream of the cutter position pulls and keeps the stringer F taut. The stringer F is thus held taut between the presser 23 and the tensioning member 24, further with presser bars 25 and 26 abutting against the tape T on opposite sides of the cutter position. This is followed by the gapping operation in which the upper and lower cutter combinations 15 and 16 are vertically moved toward each other so that the first upper and lower cutter blades 11*b* and 12*b* cut the respective connecting strings C and the second upper and lower cutter blades 13*b* and 14*b* cut the coupling elements E closely across the junction between the head and leg portions of the elements. In the case where the connecting string C is embedded in the web of the tape T which is often the case, it is desirable to make the tip end of each of the first cutter blades 11*b* and 12*b* extend slightly beyond the tip end of the second cutter blades 13*b* and 14*b* so as to ensure complete cutting of the strings C. This is illustrated in FIG. 10 in which a distance $H_1$ between the first cutter blade tip and the transverse edge or abutment 11*c* (12*c*) is greater than a distance $H_2$ between the second cutter blade and the abutment 11*c* (12*c*). This distance relationship is variable with the dimensions of the coupling elements E to be processed. In actual operation of the apparatus therefore, the second cutters 13 and 14 engage and cut the elements E in advance of the first cutters 11 and 12 reaching the strings C, the latter cutters subsequently engaging and cutting the strings C completely, while there remain partly uncut portions of the elements E. In this position, the abutments 11*c* and 12*c* of the first cutters 11 and 12 hold down the tape T against the guide block 21 and arrest leg portions $E_b$ and $E_c$. The gripper 20 then grabs and pulls the head portion Ea of the elements E apart from the remaining leg portions Eb and Ec in the direction of the arrow transversely of the stringer F, when there may be burrs 27 representing separation from the uncut portions that have not been fully severed by the cutters 13, 14 as shown in FIG. 13. Further retractive movement of the gripper 20 causes the trailing edges of cut head portions of the elements E to slip out from under the sewn seams S as shown in FIG. 14.

Figure 14:
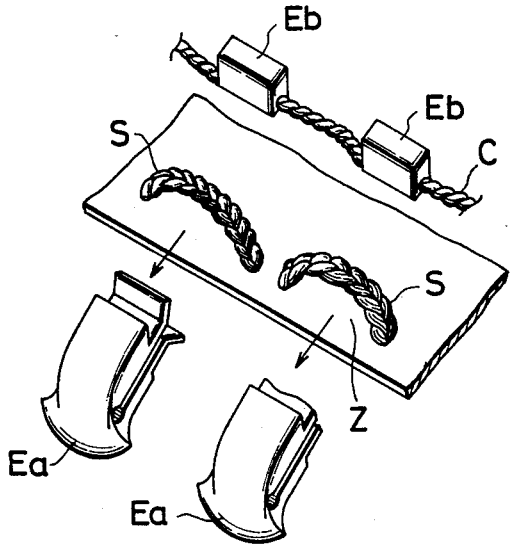
FIG. 14 is a perspective fragmentary view of a slide fastener stringer shown with the coupling elements removed.

Upon retraction to their respective original positions of the cutter combinations 15 and 16, the leg portions Eb and Ed cut off by the cutters and the head portions Ea released from the gripper 20 are all removed by air blow, leaving an element-free zone Z on the tape T with sewn seams S left thereon substantially in the form of an arch as shown in FIG. 14, indicating successful gapping without affecting the normal alignment of the operative successive elements on opposite ends of the element-free zone Z.

While the process and apparatus of the invention has been described above in connection with the mode of operation in which the connecting string C and the coupling elements E are cut substantially simultaneously, the invention may also be embodied in such a way as to first simultaneously cut the string C and arrest or clamp the leg portions of the elements E and thereafter cut off the elements E. This alternative process can be effected by arranging the first pair of cutters 11, 12 and the second pair of cutters 13, 14 to be movable independently relatively to each other.

Obviously, various modifications and variations of the present invention are possible in the light of the above teaching. It is therefore to be understood that within the scope of the appended claims the invention may be practiced otherwise than as specifically described.

What is claimed is:

1. A process of gapping a slide fastener chain having a pair of stringers each including a support tape, a series of discrete coupling elements secured by sewn seams to a longitudinal edge of said tape, each of said elements having a head portion and an upper and a lower leg portion, and a pair of connecting strings interconnecting said upper and lower leg portions respectively in said series of coupling elements, the process which comprises the steps of:

(a) cutting said conneoting strings and a predetermined number of said coupling elements simultaneously;

(b) arresting the leg portions of said coupling elements that have been cut;

(c) pulling the cut head portions of said coupling elements apart from their leg portions; and (d) removing the remaining cut leg portions of said coupling elements from said tape.

2. A process of gapping a slide fastener chain having a pair of stringers each including a support tape, a series of discrete coupling elements secured by sewn seams to a longitudinal edge of said tape, each of said elements having a head portion and an upper and a lower leg portion, and a pair of connecting strings interconnecting said upper and lower leg portions respectively in said series of coupling element, the process which comprises the steps of:

(a) cutting said connecting strings and simultaneously arresting the leg portions of the coupling elements which are to be cut;

(b) cutting a predetermined number of said coupling elements across the junction between said head and said leg portions thererof;

(c) pulling the cut head portions of said coupling elements apart from their leg portions; and (d) removing the remaining cut leg portions of said coupling elements from said tape.

* * * * *